US010731659B2

(12) United States Patent
Zhou et al.

(10) Patent No.: US 10,731,659 B2
(45) Date of Patent: Aug. 4, 2020

(54) ENERGY-SAVING AND ENDURABLE AUTO ELECTRIC WATER PUMP

(71) Applicant: Feilong Auto Components Co., Ltd., Xixia Nanyang, Henan (CN)

(72) Inventors: Xiangqing Zhou, Henan (CN); Fan Feng, Henan (CN); Jianhua Tang, Henan (CN)

(73) Assignee: FEILONG AUTO COMPONENTS CO., LTD., Henan (CN)

( * ) Notice: Subject to any disclaimer, the term of this patent is extended or adjusted under 35 U.S.C. 154(b) by 243 days.

(21) Appl. No.: 15/258,455

(22) Filed: Sep. 7, 2016

(65) Prior Publication Data

US 2017/0082117 A1 Mar. 23, 2017

(30) Foreign Application Priority Data

Sep. 18, 2015 (CN) ..... 2015 1 0596756

(51) Int. Cl.
*F04D 29/42* (2006.01)
*F04D 13/06* (2006.01)
(Continued)

(52) U.S. Cl.
CPC ..... *F04D 29/4293* (2013.01); *F04D 13/06* (2013.01); *F04D 13/0626* (2013.01);
(Continued)

(58) Field of Classification Search
CPC ..... F04D 29/4293; F04D 29/5813; F04D 13/0686; F04D 13/0626; F04D 13/06;
(Continued)

(56) References Cited

U.S. PATENT DOCUMENTS 4,255,936 A * 3/1981 Cochran ..... F04D 13/06 62/238.7
4,775,293 A * 10/1988 Boster ..... F04D 29/5866 277/408
(Continued)

FOREIGN PATENT DOCUMENTS

CN 204591691 U 8/2015

*Primary Examiner* — Charles G Freay
*Assistant Examiner* — Lilya Pekarskaya
(74) *Attorney, Agent, or Firm* — Rossi, Kimms & McDowell LLP

(57) ABSTRACT

A kind of an energy-saving and endurable auto electric water pump, including fixed support, electrical connector, rear cover of motor, controller assembly, motor assembly, isolation sleeve, impeller assembly and pump head housing, and the said fixed support and said electrical connector are set on the outer end surface of the rear cover of the motor, the controller assembly is mounted on the inner end face of the rear cover of the motor, and rear cover of the motor is mounted together with the motor assembly, the said impeller assembly is installed together with the isolation sleeve through rotating axis, while the water-cooling mechanism is set on the controller assembly. In the present invention, the water cooling mechanism is set on the controller of the electric water pump, which can effectively reduce the temperature of the controller and improve the service life of the pump.

8 Claims, 9 Drawing Sheets

(51) Int. Cl.
*F04D 29/58* (2006.01)
*F04D 29/22* (2006.01)

(52) U.S. Cl.
CPC ..... *F04D 13/0686* (2013.01); *F04D 29/22* (2013.01); *F04D 29/5813* (2013.01); *F04D 29/5866* (2013.01); *F05B 2240/14* (2013.01); *F05B 2250/70* (2013.01); *F05B 2260/20* (2013.01)

(58) Field of Classification Search
CPC .. F04D 29/5866; F04D 29/22; F05B 2260/20; F05B 2240/14; F05B 2250/70
See application file for complete search history.

(56) References Cited

U.S. PATENT DOCUMENTS 5,143,515 A * 9/1992 Boster ..... F04D 7/06 277/431
5,246,337 A * 9/1993 Boster ..... F04D 29/047 165/134.1
2006/0057005 A1* 3/2006 Williams ..... F04D 13/0606 417/423.14
2008/0031748 A1* 2/2008 Ihle ..... F04D 29/026 417/321
2010/0135793 A1* 6/2010 Krauss ..... F16N 7/40 416/1
2011/0116947 A1* 5/2011 Yi ..... F04D 13/0633 417/410.1
2012/0073950 A1* 3/2012 Kamen ..... B01D 1/28 202/187
2015/0184674 A1* 7/2015 Lee ..... F04D 13/0686 417/366

* cited by examiner

ENERGY-SAVING AND ENDURABLE AUTO ELECTRIC WATER PUMP

FIELD OF THE INVENTION

The present invention relates to an energy-saving and endurable auto electric water pump, which belongs to the field of electric water pump.

BACKGROUND OF THE INVENTION

Auto water pump is a device for conveying engine coolant, which contains mechanical pumps and electric pumps according to the driving mode, and electric pumps can be divided into brush electric water pumps and brushless electric water pumps. Mechanical pumps rely on the engine, and the fixed rate between pump speed and engine speed cannot meet the cooling requirements at low speed and high load, and when the engine stops, it is unable to meet the cooling requirements of main drive motor and other components of new energy vehicles as well as water supply requirements of motor homes. The brush electric water pump has poor anti-electromagnetic interference capability, and the brush tends to produce sparks that disturb other electronic devices. At the same time, influenced by the reversing carbon brush wear, the brush electric pump has a short service life, not suitable for new energy vehicles. Therefore, the DC brushless pump will be more and more used in high-end vehicles, new energy vehicles and motor homes.

The motor pump has following problems:

(1) The magnet of brushless DC magnetic drive pump and impeller are molded into a integrally composed rotor through injection, there is a sleeve in the center of the rotor fixed in the housing by high performance ceramic axis, and the stator portion of the motor and the circuit board is potted in the pump body by epoxy glue, thus the existing water pump has followings defects: difficulty of manufacturing technology, high production costs, difficult repair and media leaks, and the waterproof performance is not good, which affects the use of the motor. There are some motor pumps with separated rotor and impeller to the existing motor pumps, such as Publication No. CN 204591691U with the name of DC Brushless Auto Electric Water Pump. With distance sleeve, there is a cavity to accommodate the rotor. At the center of the inner bottom surface of the cavity, there is a lug boss to fix the pump shaft, one end of the shaft insert into the lug boss, rotation and axial movement are not allowed, and the other end of the shaft is inserted in the sleeve of the shaft head holder inside the pump head to separate the rotor and impeller in different spaces, which effectively prevents the medium leakage problems in the water pump, but with the problems of complex structure and inconvenient dismantling. Furthermore, the outlet of the DC brushless auto electric water pump faces the impeller, making the water flow be thrown out rapidly by a centrifugal force through the acceleration of the impeller, the noise of the water pump is large, the operation is unsteady and the service time of electric water pump is short.

(2) In addition, in the operation of water pump motor, the motor controller is easier to go wrong, the temperature increasing of motor is fast in the operation process of motor, and it keeps high temperature during the operation. It is likely to cause the controller burned and may reduce the life of the controller. Generally, the cooling equipment of the existing machine controller has heat sink or silicone pad and reduces the temperature of the controller through hot and cold air exchange. But the heat sink or silicone pad adopts the way of air heat exchange for heat dissipation, on one hand, the hot air generated by heat exchange cannot be exhausted out off the pump timely and as the long time operation of the motor, the cooling effect is decreased gradually, and on the other hand the heat dissipation effect of heat sink and the silicone pad itself is general which cannot effectively reduce the temperature of the controller.

(3) The impeller and rotor of the motor pump mounted together by a rotating shaft, generally the rotation shaft is graphite shaft. Rotation and axial movement exist during the operation. Axial movement can cause damage to the graphite shaft and the unsteady operation of motor. The existing installation methods generally suit the integrally molded impeller and rotor on the rotation shaft, which fix one end of the rotating shaft to the lug boss of the isolation sleeve, and fix the other end on the pump housing through shaft. The rotor moves at high speed, and the above installation cannot solve the problem of axial movement.

SUMMARY OF THE INVENTION

The present invention provides an energy-saving and endurable auto electric water pump; it has the advantages of stable operation and long service life, which can solve the above problems.

In order to solve the above technical problems, the technical solution adopted by the present invention is as follows: A kind of an energy-saving and endurable auto electric water pump, including fixed support, electrical connector, rear cover of motor, controller assembly, motor assembly, isolation sleeve, impeller assembly and pump head housing, the isolation sleeve includes barrel portion, the center of the bottom surface of the said barrel portion formed a cylindrical lug boss which has a hole in the center, a rotating axis is inserted into the hole, and the fixed support and said electrical connector are set on the outer end surface of the rear cover of the motor. The assembly of the controller connected with the rear cover of the motor, and the rear cover of motor is connected with the motor assembly, the impeller assembly installed together with the isolation sleeve through rotating axis, and the barrel portion of the isolation sleeve extends into the interior of the motor assembly, which separate the motor assembly and the impeller assembly, while the water-cooling mechanism is set on the controller assembly.

Further, a preferred embodiment of the present invention is: the said water-cooling mechanism includes the heat exchanger, inflow pipe and outflow pipe, the inflow pipe end is connected with the water outlet of the pump and the other end is connected with the outflow pipe, and the outflow pipe end away from the heat exchanger is connected with the water inlet of the pump.

Further, a preferred embodiment of the present invention is: the said inflow pipe and the said outflow pipe are set at the external wall or the inner of the said motor housing and the said water pump head housing.

Further, a preferred embodiment of the present invention is: the said heat exchanger is a coil heat exchanger.

Further, a preferred embodiment of the present invention is: the upper edge of the barrel portion outwardly extending sequentially form support portion, annular lug boss and a step portion, an water outlet passage is set on the annular lug boss.

Further, a preferred embodiment of the present invention is: the said water outlet passage includes a U-shaped groove with gradually enlarged spiral, an overflow gap is set at the intersecting position of the inlet end and the outlet end of the water outlet passage, and a shielding sheet is set at the outlet end of the water outlet passage.

Further, a preferred embodiment of the present invention is: the said impeller assembly includes a rotor and an impeller, and the said rotor and impeller are integrally injection molded.

Further, a preferred embodiment of the present invention is: a rubber support is set at the exterior of the said motor housing, and the said rubber support shrink fitting with the motor housing through the inner bore of the rubber support.

Further, a preferred embodiment of the present invention is: an adjusting shim is set between the said rotor and annular lug boss.

Further, a preferred embodiment of the present invention is: the said rotating axis penetrates the impeller assembly and installed with the water pump head housing through the end surface bearing.

Further, a preferred embodiment of the present invention is: the impeller assembly stopper mechanism is set at the top of the rotating axis, and the stopper mechanism of the impeller assembly is pressed into the rotating axis from the top to limit the axial movement of the impeller assembly.

The beneficial effect of the invention:

In the present invention, the water cooling mechanism is set on the controller of the electric water pump. The water cooling mechanism and the motor water pump share one water-cycling system jointly and the structure is simple, which can effectively reduce the temperature of the controller and improve the service life of the pump.

In the present invention, the structure of the auto electric water pump is simple, the motor assembly and the impeller assembly are separated by the isolation sleeve, and water outlet passage is set on the distance sleeve, so that water cannot enter the motor assembly and controller assembly, thus it can play a protective role for the electrical system. At the same time, the manufacturing technology of separation method that dividing the motor assembly and impeller assembly by isolation sleeve is simple, and the manufacturing costs is low, which can effectively reduce the noise of the electric water pump during the running time and increase the service life of the electric water pump.

In the present invention, the impeller assembly stopper mechanism is set at the top of the rotating axis of the auto electric water pump, and adds axial stop functions to the rotor during operation, which can effectively prevent axial movement when the rotation axis moves at high speed and improve the service life of the auto electric water pump and stability of operation.

BRIEF DESCRIPTION OF THE DRAWINGS

In order to clearly explain the embodiments or the technical solutions of the current technology, hereafter we will briefly introduce the attached drawings required for the embodiments or the technical solutions, obviously, the attached drawings described below are only some embodiments of the present invention, those of ordinary skill in the art can also obtain other drawings based on these attached drawings without creative efforts.

In the figures, reference number 1 is fixed support, 2 is electrical connector, 3 is rear cover of motor, 4 is silicone gasket, 5 is heat exchanger, 5-1 is housing heat exchanger, 5-2 is coil heat exchanger, 6 is sealing gasket, 7 is controller assembly, 8 is motor assembly, 8-1 is motor housing, 8-2 is stator core, 8-3 is stator frame, 8-4 is varnished wire, 8-5 is PCB, 8-6 is three-phase lead, 9 is rubber holder, 10 is bushing, 11 is O-ring, 12 is isolation sleeve, 12-1 is step portion, 12-2 is annular lug boss, 12-3 is support portion, 12-4 is cylindrical lug boss, 12-5 is rotating axis, 12-6 is barrel portion, 12-7 is water outlet passage, 12-8 is shielding sheet, 12-9 is overflow gap, 12-10 is stopper mechanism of impeller assembly, 13 is adjusting shim, 14 is impeller assembly, 14-1 is impeller, 14-2 is rotor, 15 is an end surface bearing, 16 is seal ring, 17 is pump head housing, 18 is blanking cover, 19 is inflow pipe, 20 is water inlet, 21 is water outlet, and 22 is outflow pipe.

DETAILED DESCRIPTION OF THE INVENTION

A clear and complete description of the technical solutions of the embodiments in the present invention will be given in combination with the attached figures of the embodiments in the present invention. Obviously, the described embodiments are only part of the embodiments in the present invention rather than all embodiments. All other embodiments obtained by those of ordinary skill in the art before they make creative labor based on the embodiments of the present invention are all belong to the scope of protection of the present invention.

Embodiment 1

Figure 1:
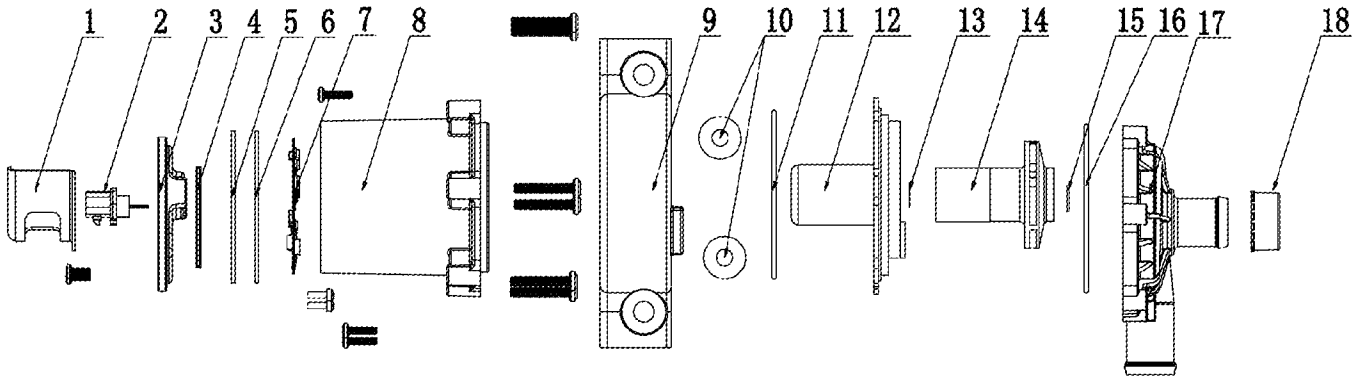
FIG. 1 shows the exploded diagram of electric water pump of embodiment 1.

As shown in FIG. 1, the energy-saving and endurable auto electric water pump is comprised of fixed support 1, electrical connector 2, rear cover of motor 3, controller assembly 7, motor assembly 8, isolation sleeve 12, the impeller assembly 14 and pump head housing 17.

Figure 2:
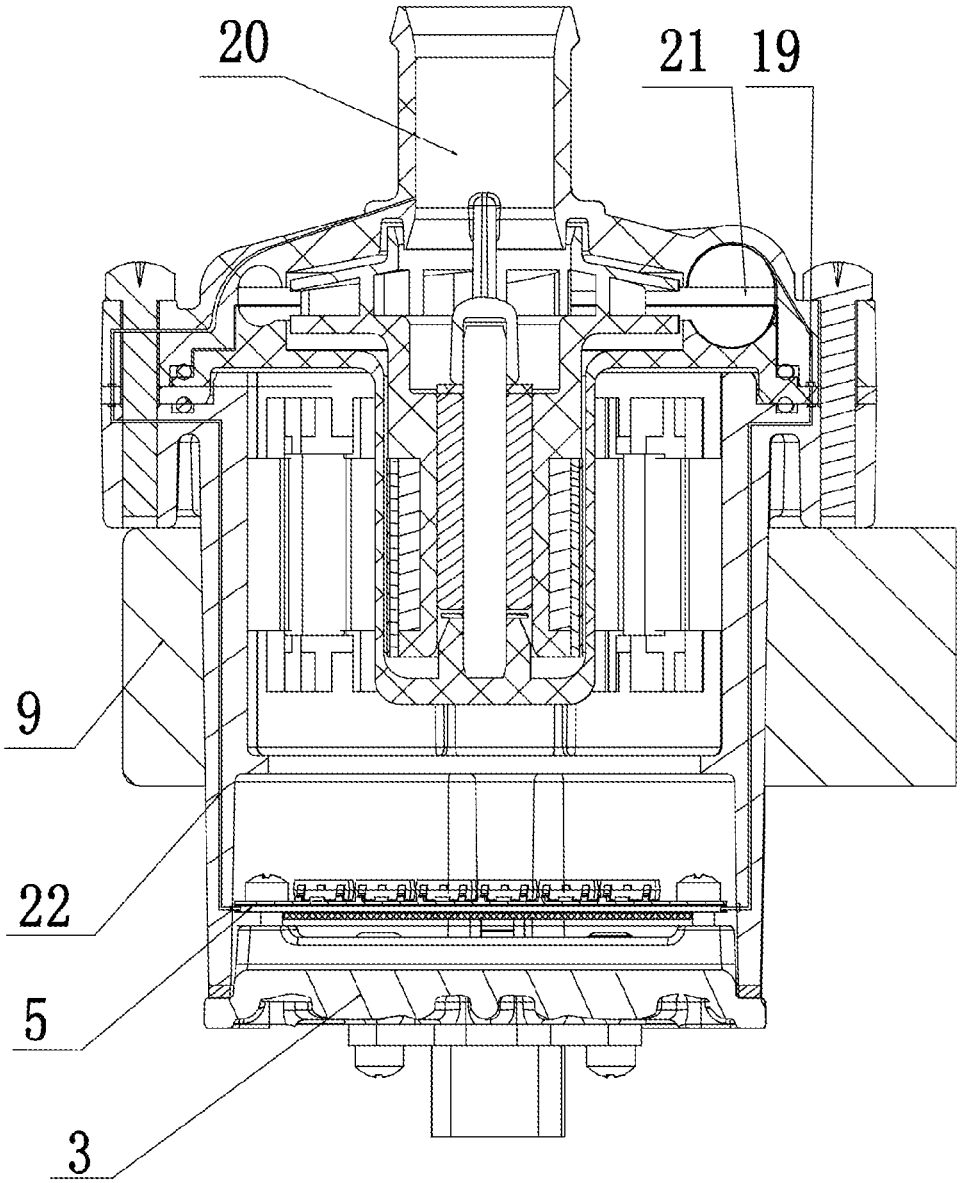
FIG. 2 is a structural diagram of electric water pump of embodiment 1.

As shown in FIG. 2, fixed support 1 and electrical connector 2 are mounted on the outer end face of rear cover 3 of motor, the controller assembly 7 is mounted on the inner end face of the rear cover 3 of the motor, and rear cover 3 of the motor is mounted together with the motor assembly 8.

Figure 5:
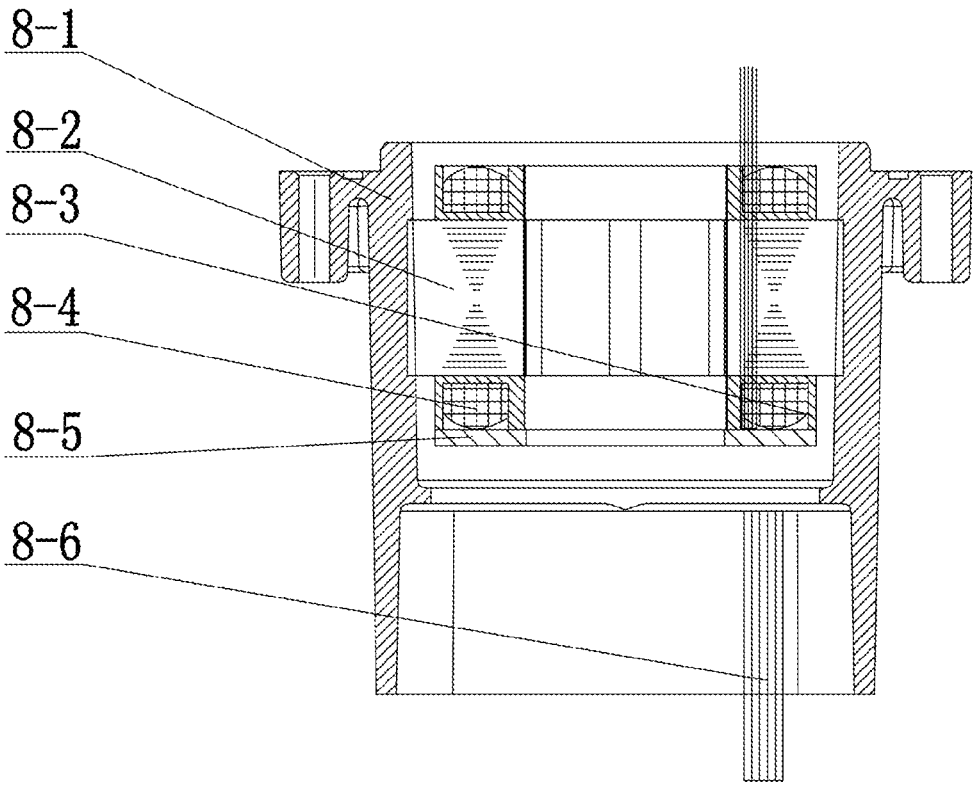
FIG. 5 is a structural diagram of the motor assembly of embodiment 1.

As shown in FIG. 5, the motor assembly 8 in the present invention includes a three-phase lead 8-6: power on effect; PCB (Printed circuit board) 8-5: fixed three-phase lead 8-6; varnished wire 8-4: produces a magnetic field through electric current after winding, to make motor rotor 14-2 rotate; stator frame 8-3: fixed stator core 8-2, varnished wire 8-4 and PCB 8-5 plate; stator core 8-2: magnetic conductive, collect flux to make the magnetic force lines do not diverge; the motor housing 8-1: fixed stator frame 8-3, stator core 8-2, water pump head housing 17 and rear cover 3 form together as one complete unit.

In the present invention, the controller assembly 7: printed wiring, providing electrical connection and fix electrical components between the components, functions: actively control the motor operates according to the designed direction, speed, angle and response time through integrated circuit to make the application scope of the motor wider and it has the characteristics of higher output efficiency and lower noise.

Figure 6:
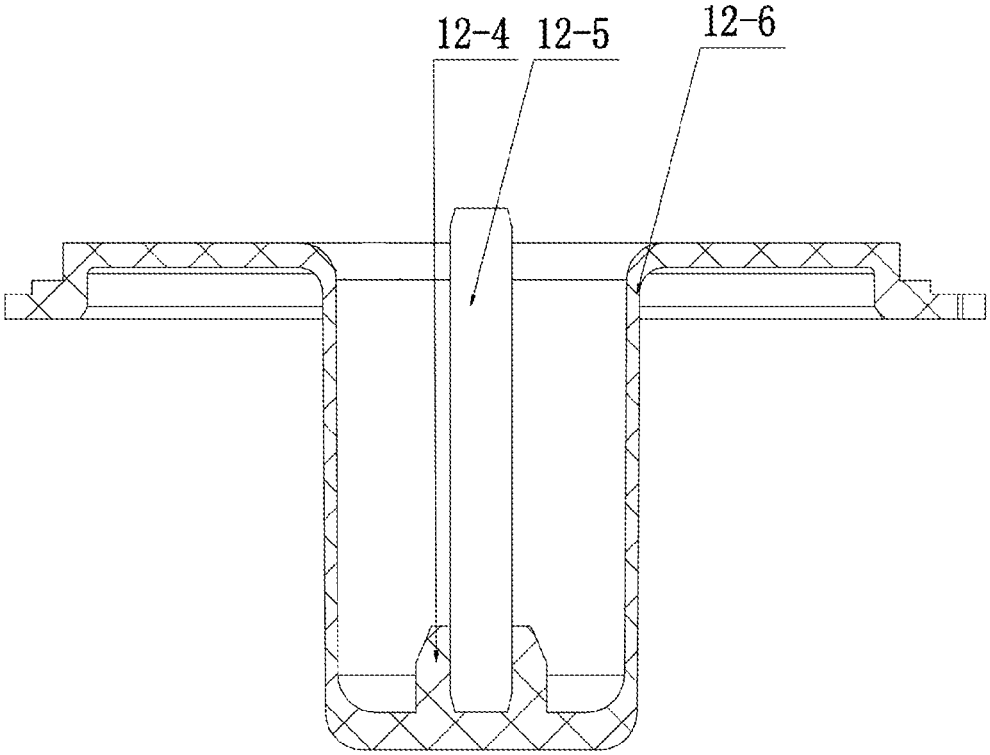
FIG. 6 is the front view of isolation sleeve of embodiment 1.

As shown in FIG. 6, the isolation sleeve 12 in this embodiment includes a barrel portion 12-6, the center of the bottom surface of the said barrel portion 12-6 formed a cylindrical lug boss which has a hole in the center, a rotating axis is inserted into the said hole, and the barrel portion 12-6 of isolation sleeve 12 extends into the interior of the stator and separates the motor assembly 8 and the impeller assembly 14.

Figure 7:
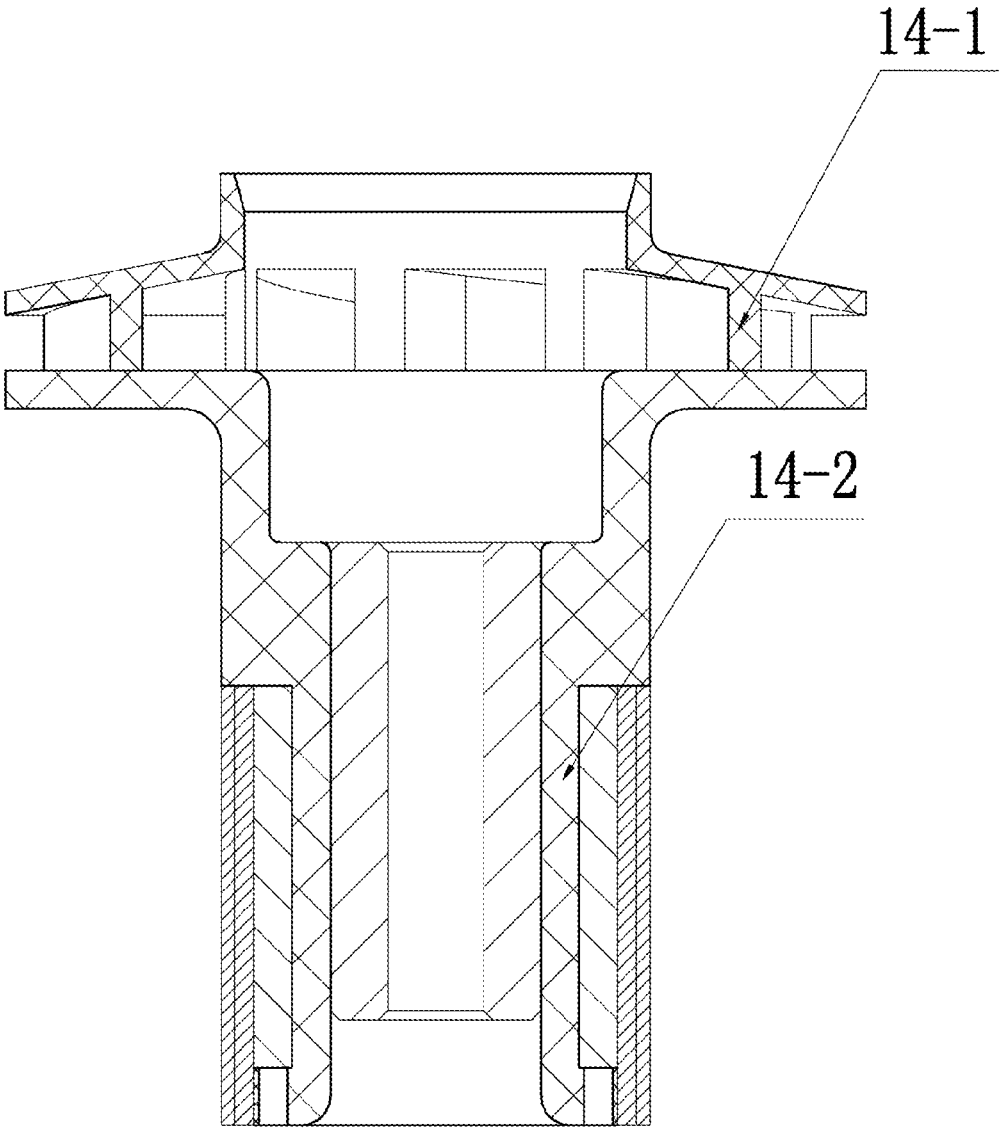
FIG. 7 is a structural diagram of impeller assembly of embodiment 1.

As shown in FIG. 7, in the present invention, the impeller assembly 14 includes a rotor 14-1 and impeller 14-2, rotor 14-2 and impeller 14-1 are molded together through injection. Rotor 14-2 and impeller 14-1 injection molded together can effectively improve the sealing between them, thereby increasing the service life.

The installation ways of rotor 14-2 and impeller 14-1 can also be other ways. For example, they can be bolted together, but attention should be paid to the sealing.

Rotating axis 12-5 penetrates the impeller assembly 14 and is installed with pump head housing 17 through end surface bearing 15. The end surface bearing 15 is also called section bearing or plane bearing which is used to bear the axial force of the rotating axis.

The electric water pump in the present invention is provided with water-cooling mechanism on the controller assembly 7.

Figure 3:
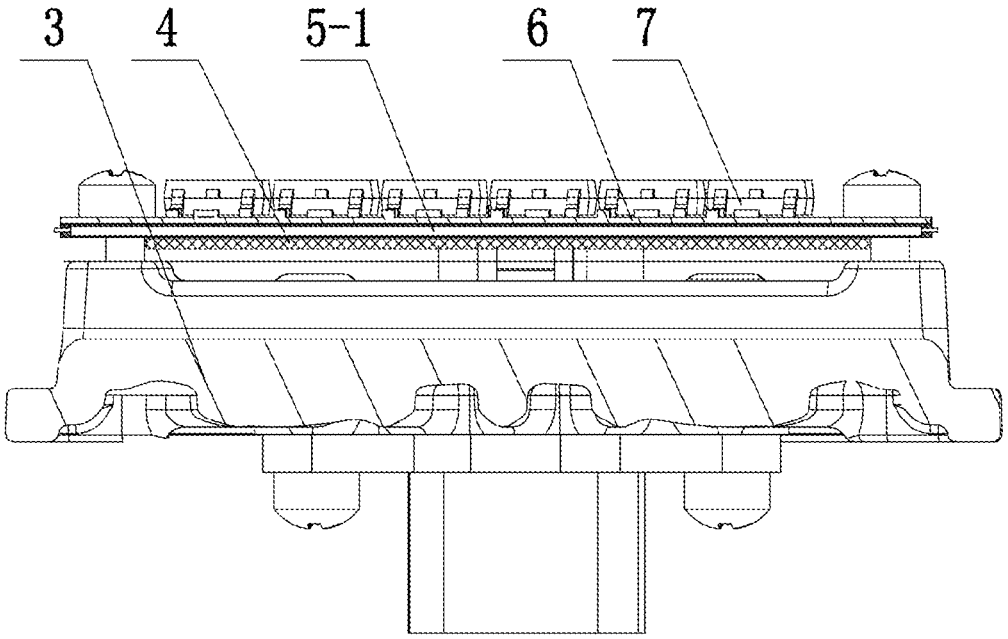
FIG. 3 is a structural diagram of rear cover of motor and controller assembly of embodiment 1.

As shown in FIG. 3, in the present invention, the water-cooling mechanism includes a heat exchanger 5, the inflow pipe 19 and outflow pipe 22, heat exchanger 5 are provided at the back of the controller assembly 7, the inflow pipe 19 and outflow pipe 22 are provided inside the motor housing 8-1 and the pump housing 17, one end of inflow pipe 19 is connected with water outlet 21 of the pump and the other end is connected with the water inlet end of the heat exchanger 5, and one end of the outflow pipe 22 is connected with the water inlet 21 of the pump and the other end is connected with the water outlet end of the heat exchanger 5.

As shown in FIG. 3, in this embodiment, sealing gasket 6, housing heat exchanger 5-1 and gasket 4 are sequentially arranged behind the controller assembly 7, and they are mounted together with the rear cover 3 of the motor by bolts. The gasket is preferably made of silicon silica gel or silicon resin. The housing heat exchanger 5-1 in this embodiment is a circular box, and water inlet and outlet are set to the box body. The inflow and outflow pipe in this embodiment is the passage set in the motor housing and the pump head housing. The water inlet 20 and inflow pipe 19 are connected together by screw, and water outlet and outflow pipe 22 are also connected together by screw. Inflow pipe 19 and outflow pipe 22 are passages set within the motor housing 8-1 and pump head housing 17, the pipes in the passages within motor housing 8-1 and water pump head housing 17 are threaded connect by the screwed fittings, other connection ways are also possible.

In this embodiment, heat exchanger 5 is set at the rear of controller assembly 7, and heat exchanger 5 and water pump share one power source through pipes. On one end, it can effectively reduce the operational problems of controller assembly 7, and on the other hand, the structure is simple without adding new sources of power to the water pump.

Figure 4:
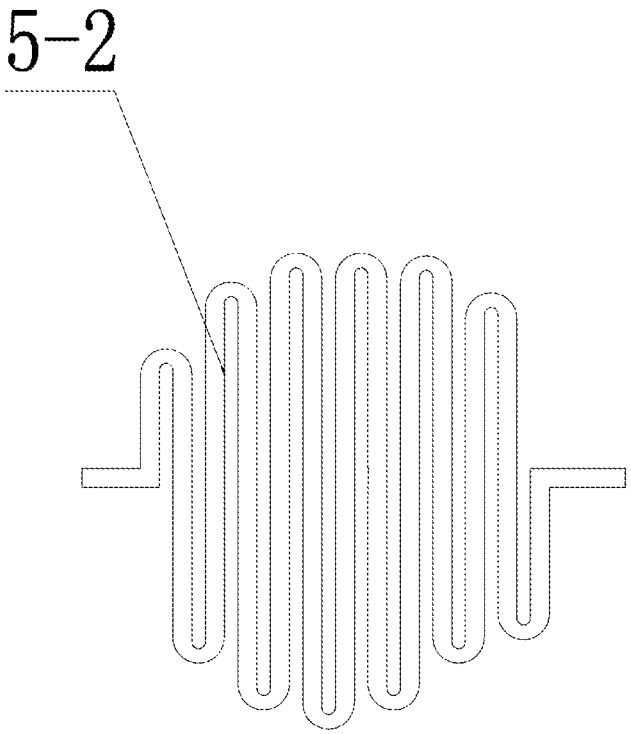
FIG. 4 is a structural diagram of coil heat exchanger of embodiment 1.

In the present invention, heat exchanger 5 may have other forms, such as plate-fin radiator and coil heat exchanger, as shown in FIG. 4 a coil heat exchanger 5-2. Using coil heat exchanger 5-2, the coil and inflow pipe 19 and outflow pipe 22 formed integrally, and inflow pipe 19 and outflow pipe 22 are clamped in the groove of motor housing 8-1 and pump head housing 17. Inflow pipe and outflow pipe can also be fixed on the motor housing and the outer wall of the pump housing. With the above structure, the overall tightness of the heat exchanger 5 is good, which can effectively prevent water leakage occurs in the flow process that would affect controller assembly 7.

A preferred embodiment of this embodiment is: rubber holder 9 is set at the outer of the motor housing 8-1, and the rubber holder 9 shrink fitting with the motor housing 8-1 through the inner bore. The inner holes of rubber holder 9 are installed with bushing 10. Two bushings 10 are installed in the corresponding inner holes of rubber holder 9. The rubber holder 9 is fitted over the excircle of motor housing 8-1 and plays the role of vibration damper, and by adding bushings 10 may increase the torque screws to prevent loosening. Isolation sleeve 12 and motor housing 8-1 can be installed together by bolt. O-ring 11 is set between motor housing 8-1 and isolation sleeve 12.

In the present invention, adjusting shim 13 is set between rotor 14-2 and annular lug boss 12-2 so that the mounting position of the rotor 14-2 and cylindrical lug boss 12-4 can be easily and quickly adjusted to make the rotor 14-2 mounted in a suitable location.

In the present invention, blanking cover 18 is set for the outflow pipe 22 and inflow pipe 19 to prevent dust and foreign matter from entering the water pump, thus to protect the pump.

Embodiment 2

Figure 8:
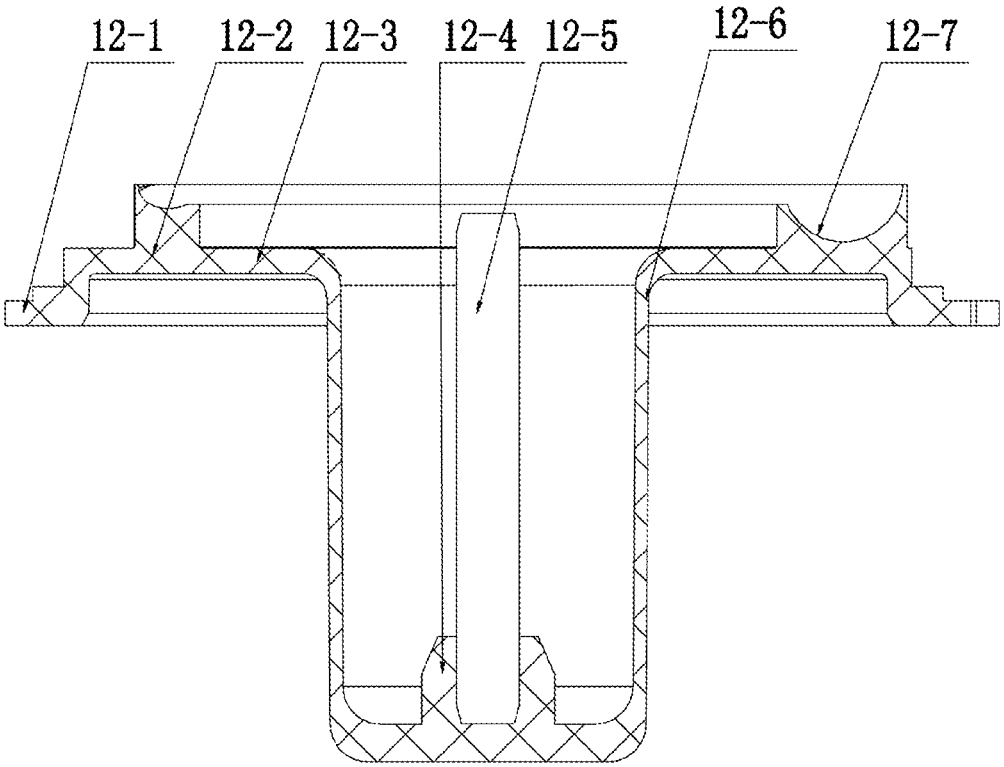
FIG. 8 is the front view of isolation sleeve of embodiment 2.

The structure of embodiment 2 is basically the same with embodiment 1, except that: as shown in FIG. 8, the upper edge of the barrel portion 12-6 of isolation sleeve 12 extends outwardly and sequentially forms support portion 12-3, annular lug boss 12-2 and step portion 12-1, and a water outlet passage 12-7 is provided on circular lug boss 12-2.

The step portion 12-1 of isolation sleeve 12 corresponds to water pump housing 17, isolation sleeve 12 plays the role of a gasket to make the sealing effect better. Seal ring 16 can be respectively set for the upper and lower surface of step portion 12-1, the upper seal ring 16 can prevent water leakage in the inner chamber of water pump head housing 17, the lower seal ring 16 can prevent outside water from entering the inner chamber where the motor assembly 8 and controller assembly 7 is placed.

Figure 9:
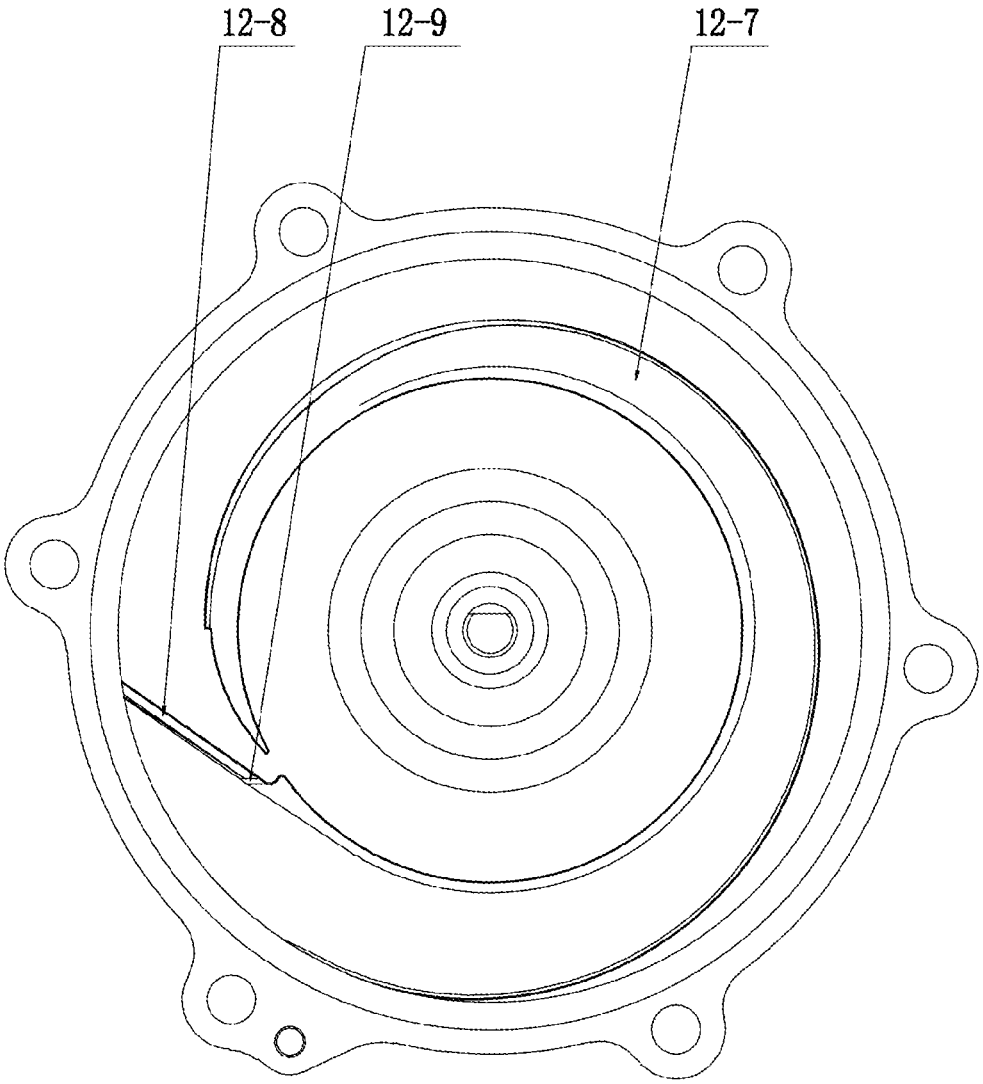
FIG. 9 is the plan view of isolation sleeve of embodiment 2.

In this embodiment, the main function of water outlet passage 12-7 is to increase the flow distance and reduce the water flow velocity after they are thrown out centrifugally from the impeller 14-1 to make the water smoothly flow back into the tank without affecting the status of the water in the tank. The shape can be set different, such as circular, square, etc. according to actual condition. As shown in FIG. 9, a preferred embodiment: the water outlet passage 12-7 includes U-shaped groove with gradually enlarged spiral, set overflow gap 12-9 at the intersect position of inlet end 20 and outlet end 21 of water outlet passage 12-7, and shielding sheet 12-8 is set at the outlet end 21 of outlet passage 12-7. The U-shaped groove with gradually increasing spiral can make the passageway gradually increase during the flow process and make the flow speed gradually slow down, to make the flow velocity at the outlet slow down to an appropriate speed and will not disturb the state in the water tank, thus to reduce noise and increase pump life. Overflow gap 12-9 can make the water flow in the outlet and inlet maintained in a balance state to further improve the stability of water flow. The shielding sheet can effectively block the water flow of the outlet to prevent the water from entering the step portion 12-1 and impacting the sealing of water pump.

Groove corresponding to outlet passage 12-7 is set on water pump head housing 17 and forms a water passage. In the present invention, all components of the isolation sleeve 12 are injection molded together.

Embodiment 3

Figure 10:
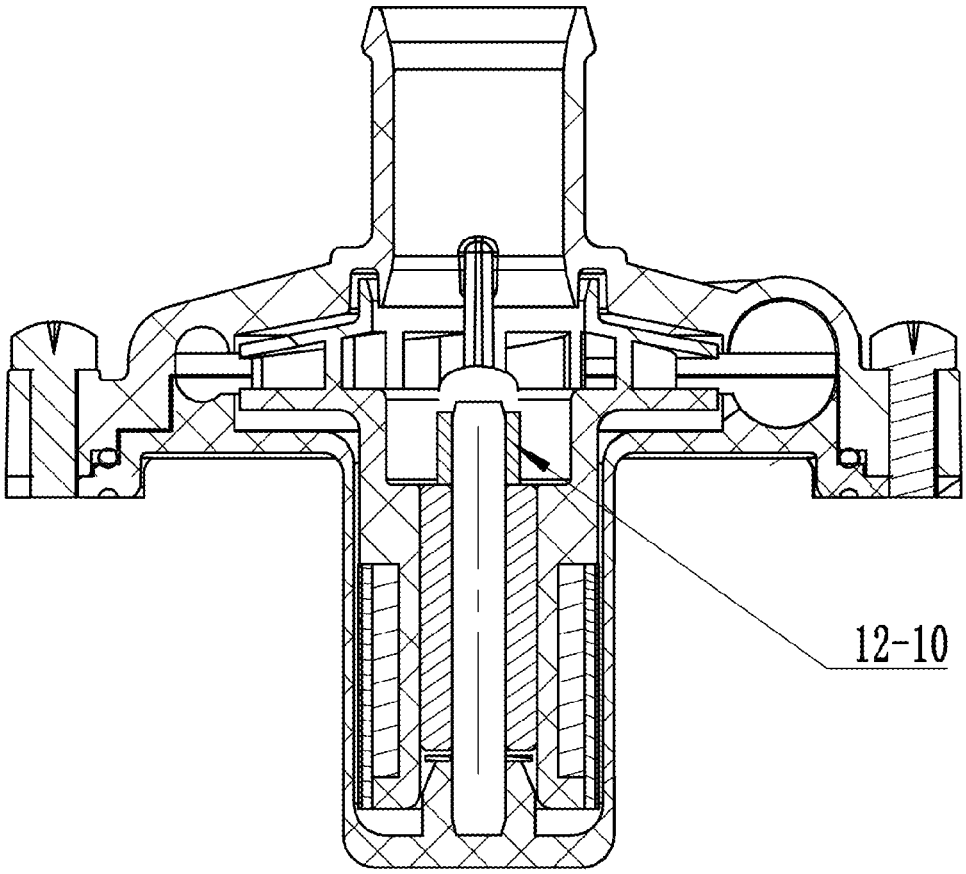
FIG. 10 is the front view of isolation sleeve of embodiment 3.

This embodiment is basically the same as embodiment 2, except that: as shown in FIG. 10, the stopper mechanism of impeller assembly 12-10 is set at the top of rotating axis 12-5, and the stopper mechanism 12-10 of said impeller assembly is generally pressed in from the top of rotating axis 12-5. The stopper mechanism of impeller assembly 12-10 is in the form of a socket that is provided on the axis in order to avoid the axial movement of the impeller assembly.

Pressing in the stopper mechanism 12-10 of the impeller assembly from the top of the rotating axis 12-5 can effectively reduce the gap between the stopper mechanism of impeller assembly 12-10 and impeller assembly 14 and reduce the axial movement of the impeller assembly 14 during operation and improve the life of electric water pump.

Operation process of the present invention:

Switch on the power, the controller assembly 7 drives the stator to produce a magnetic field and make the rotor 14-2 to rotate, impeller 14-1 rotates with rotor 14-2, the water in the center of impeller 14-1 is throw out to the surrounding, and pumped out from the outlet in a certain pressure. At the same time, due to the pressure drop at the center of the impeller 14-1, the water is pumped from the inlet, thus to achieve the water circulating in the vehicle.

The foregoing is only preferred embodiments of the present invention which is not meant to limit the invention, and any modifications or equivalent replacement, or improvement within the spirit and principles of the present invention shall be included in the scope of protection of the present invention.

What is claimed is:

1. An energy-saving and endurable auto electric water pump, the electric water pump comprising: a fixed support, an electrical connector, a rear cover of a motor, a controller assembly, a motor assembly, an isolation sleeve, an impeller assembly, and a pump head housing, wherein:

the isolation sleeve includes a barrel portion, a center of a bottom surface of the barrel portion is provided with a cylindrical lug boss which has a hole in a center of the cylindrical lug boss, a rotating axis is inserted into the hole in the center of the cylindrical lug boss, and the fixed support and the electrical connector are set on an outer end surface of the rear cover of the motor, the controller assembly is installed between the motor assembly and the rear cover of the motor and includes components, the components being electrically connected through printed wiring, and the rear cover of the motor is connected with the motor assembly, the impeller assembly is installed together with the isolation sleeve with the rotating axis penetrating the impeller assembly, and the barrel portion of the isolation sleeve extends into an interior of the motor assembly and separates the motor assembly and the impeller assembly, an upper edge of the barrel portion of the isolation sleeve extends outwardly and sequentially forms a support portion, an annular lug boss, and a step portion, and a water outlet passage is set on the annular lug boss, the water outlet passage having an inlet end and an outlet end and including a U-shaped groove with a gradually enlarged spiral, an overflow gap disposed at an intersecting position of the inlet end and the outlet end, and a shielding sheet disposed at the outlet end, and a water-cooling device is set on a lower side of the controller assembly, the water-cooling device including a heat exchanger, an inflow pipe, and an outflow pipe, the heat exchanger being provided at a back of the controller assembly, the inflow pipe and the outflow pipe being provided inside a motor housing and the pump head housing, one end of the inflow pipe being connected with a water outlet of the pump and the other end of the inflow pipe being connected with a water inlet end of the heat exchanger, and one end of the outflow pipe being connected with a water inlet of the pump and the other end of the outflow pipe being connected with a water outlet end of the heat exchanger.

2. The energy-saving and endurable auto electric water pump according to claim 1, wherein the impeller assembly includes a rotor and an impeller, and the rotor and the impeller are integrally injection molded.

3. The energy-saving and endurable auto electric water pump according to claim 1, wherein a rubber support is set at an exterior of the motor housing, the rubber support being shrink fitted with the motor housing through a bore arranged on the rubber support.

4. The energy-saving and endurable auto electric water pump according to claim 1, wherein an adjusting shim of the motor assembly is set between the rotor and the annular lug boss.

5. The energy-saving and endurable auto electric water pump according to claim 1, wherein an impeller assembly stopper is set at a top of the rotating axis.

6. The energy-saving and endurable auto electric water pump according to claim 2, wherein an impeller assembly stopper is set at a top of the rotating axis.

7. The energy-saving and endurable auto electric water pump according to claim 3, wherein an impeller assembly stopper is set at a top of the rotating axis.

8. The energy-saving and endurable auto electric water pump according to claim 4, wherein an impeller assembly stopper is set at a top of the rotating axis.

* * * * *